United States Patent [19]

Kajava

[11] 4,123,888

[45] Nov. 7, 1978

[54] LENGTHENING JOINT FOR CONCRETE OBJECTS

[75] Inventor: Antero Kajava, Espoo, Finland

[73] Assignee: Paraisten Kalkki Oy - Pargas Kolk Ab, Helsinki, Finland

[21] Appl. No.: 805,529

[22] Filed: Jun. 10, 1977

[30] Foreign Application Priority Data

Jun. 14, 1976 [FI] Finland ..... 761704

[51] Int. Cl.[2] ..... E04C 3/34

[52] U.S. Cl. ..... 52/726; 52/236.9

[58] Field of Search ..... 52/236.9, 612, 659, 52/227, 726, 236.8, 601, 236.4, 236.3; 61/56

[56] References Cited

U.S. PATENT DOCUMENTS

| | | | |
|---|---|---|---|
| 1,176,366 | 3/1916 | Ickes | 52/227 |
| 2,677,955 | 5/1954 | Constantinesco | 52/659 |
| 3,466,823 | 9/1969 | Dowling | 52/227 |
| 3,593,532 | 7/1971 | Grazel | 61/56 |

FOREIGN PATENT DOCUMENTS

| | | | |
|---|---|---|---|
| 181,826 | 4/1955 | Austria | 61/56 |

*Primary Examiner*—John E. Murtagh

[57] ABSTRACT

A device for interconnecting two precast concrete objects, such as sections of a vertical column or a horizontal floor panel, which includes two mating joint components, one of the joint components being adapted to be mounted on each of the precast concrete objects, the two mating joint components being constructed of stronger concrete than the precast concrete objects and having mating surfaces which are smaller in cross section than the confronting surfaces of the precast concrete objects. In one embodiment of the invention, a plurality of tightening bolts extend between the two mating joint components. Also, in one embodiment of the invention, one of the mating joint components includes an outwardly extending console for the purpose of joining and supporting a beam or slab.

4 Claims, 3 Drawing Figures

LENGTHENING JOINT FOR CONCRETE OBJECTS

Figure 1:
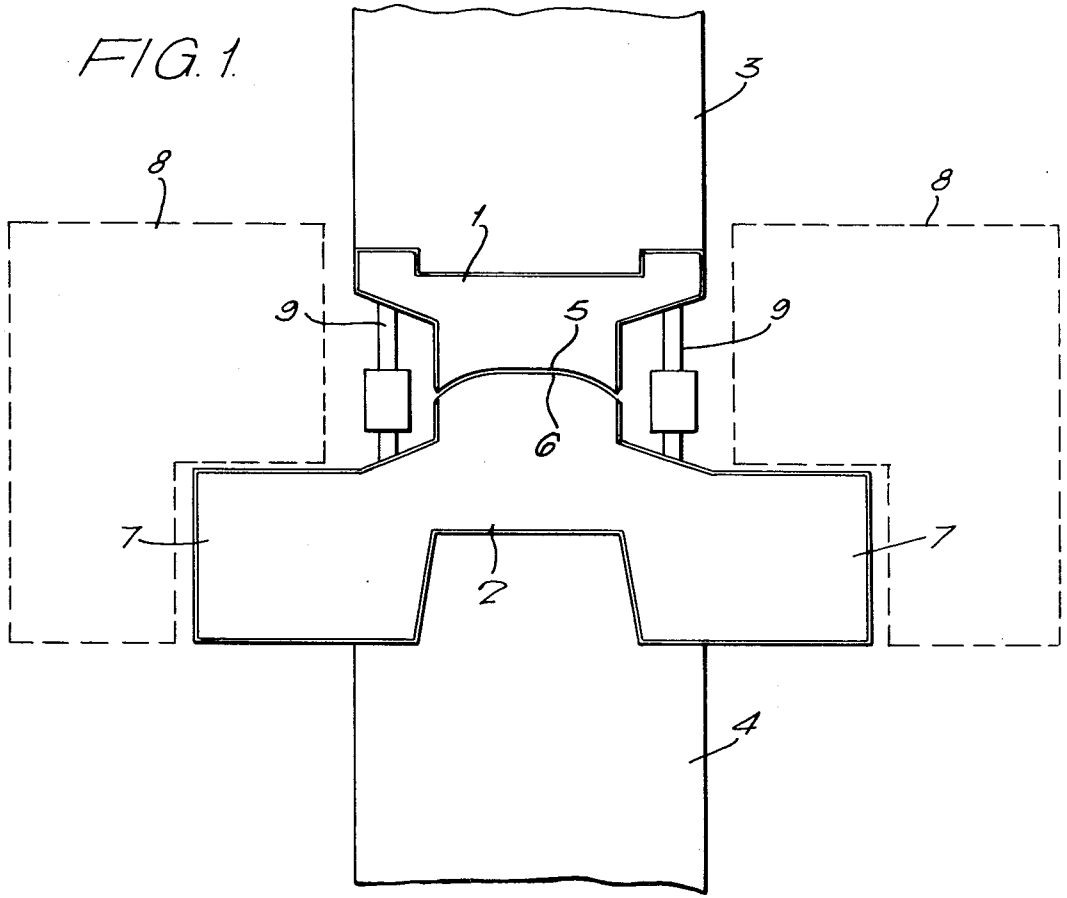

The subject of the present invention is a lengthening joint for concrete objects, such as a joint for concrete columns or for concrete slabs. The joint comprises joint components connected to the ends of concrete columns or to the joining edges of concrete slabs in advance, preferably in connection with their casting, the joint faces of the joint components of columns or slabs destined for the same joint being designed so as to correspond with each other so that the joint constitutes, for example, part of a globe or cylinder face.

Reinforced concrete columns are manufactured both at heights of one storey of a building and at heights of several storeys. In high buildings it is, however, necessary to provide columns of the height of several storeys with joints.

When standardized column lengths and a minimum selection of different elements are desired from the point of view of prefabrication in general, it is preferable to use standard columns of the height of one storey only even in the case of high buildings.

Especially in the latter cases, satisfactory design of the joints of columns is problematic, because advantages obtained in the production tend to be largely lost either because of increased installation costs or because of the high cost of the joint components.

Functionally, the joints may be either articulated (twisting permitted), rigid (twisting excluded), or partly rigid joints of certain degrees.

The solutions used have mostly been based on one of the following embodiments:

1. steel shoes + welding
2. steel shoes + bolts
3. subsequent casting of the column regarding the section required by the reinforcement strands
4. injection joint, in which the joint strands passing beyond the joint are injected in position by means of mortar.

Moreover, it is possible to think of the joint as formed analogically with a pile joint as consisting of a steel sleeve + mortar jointing principle. When aiming at speed, attempts have also been made to substitute for the cement mortar by various plastics mortars and glues.

Also, it is a previously known procedure to shape one of the joint faces concave and the other one, correspondingly, convex, as a globe or cylinder face. Such a joint has the advantage of quick installation, distribution of the strains immediately uniformly over the joint faces, and easy adjustment of the vertical position. A drawback consists of the strict requirement of length tolerances of the columns, because any adjustment at the joint face is difficult. Moreover, it is a known procedure to attempt to increase the resistance capacity of the joint by, in connection with the casting of the column, providing the column ends with components made of metal, e.g. cast iron, and constituting shell-type joint faces.

The object of the present invention is to provide a lengthening joint for concrete objects, which joint is more advantageous than those known earlier and whose principle of construction is suitable both for joints of concrete columns and for joints between slab-shaped or plate-shaped concrete elements, and the invention is mainly characterized in that the joint components and their joint faces coming to face each other are made of concrete or of any other cement-base material preferably so that the concrete quality or any other cement-base material quality of the joint components and especially of their joint faces is of a higher strength than the column mix of the concrete columns proper or the slab mix of the concrete slabs and that the cross-sectional area of the joint components at the joint is smaller than the cross-sectional area of the columns or slabs themselves.

Figure 2:
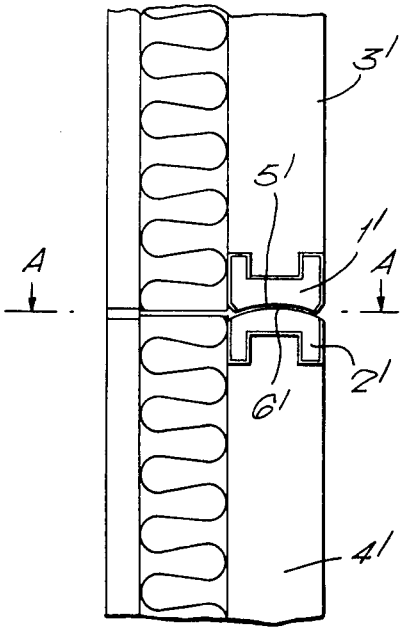
Figure 3:
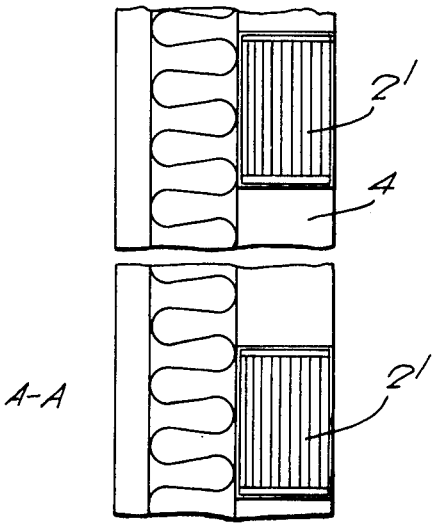

The details, advantages, and purpose of the invention come out more closely from the following description and from the attached drawings, wherein FIG. 1 is a schematical view of a joint between concrete columns as viewed from the side, FIG. 2 shows a joint in accordance with the present invention between two wall elements as a cross-sectional view, and FIG. 3 is a cross section of FIG. 2 at A—A.

According to the invention, in a joint of columns (FIG. 1), the joint faces 5 and 6 are made of concrete or of any other cement-base material so that the joint components 1 and 2 are concreted as a different casting operation out of a concrete mix of appropriate properties and are, preferably in connection with the casting of the column proper, mounted in position to the ends of the column.

In accordance with the figure, the joint faces 5 and 6 of the joint components 1 and 2 are shaped to correspond to each other so that the joint constitutes, for example, part of a globe or cylinder face.

If necessary, the joint faces 5 and 6 can be made of a concrete quality stronger than the rest of the column mix. There are, in itself, several modes of obtaining high strength concrete, e.g. using a very low ratio of water to cement, a mode of production with efficient removal or air, or additional components such as various fibres, polymers, etc. in the concrete mix. One way of producing a concrete quality of, e.g., higher tensile strength at the ends of a column, as compared with the rest of the concrete in the column, might be to use steel fibres in the concrete mix and to shift or direct the steel fibres, by means of a magnet, appropriately to the joint faces. The joint face may be formed even remarkably smaller than the cross-section of the column 3 and 4, in which case, if the joint is supposed to be made moment-rigid, the tightening bolts 9 can be placed inside the cross-section, i.e. side faces, of the column so that no harmful projections are produced in the cross-section form of the column.

According to the invention, the lower joint component 2 of the joint may be provided with connecting means, such as consoles 7, for the purpose of joining and supporting a beam 8 or slab. In such a case the connecting means are preferably of one piece with the joint components 2.

The casting mould or machine for manufacturing the joint components 1 and 2 is relatively inexpensive, because quite small concrete objects are concerned - inexpensive even if the method were provided with efficient removal of air from the mix.

As compared with joint components of steel or iron, an advantage is the remarkably lower cost of the joint components, rustlessness even as such, and better resistance to fire.

FIGS. 2 and 3 illustrate application of the joint construction shown above in connection with joints of columns to joints between slab-shaped elements, such as horizontal joints between wall elements. In such a case, the joint faces 5' and 6' at the joint between slabs 3' and 4' are, in agreement with the above, made of concrete or of any other cement-base material so that the joint components 1' and 2' are concreted as a separate casting operation out of a concrete mix of appropriate properties and, preferably in connection with the casting of the concrete slabs proper, mounted in position at the joint edges of the slabs. The joint components 1' and 2' do, of course, not have to extend over the entire length of the joint edges of the slab 3' and 4', but there may be two or more of them connected to the slabs at appropriate positions at the joint edges in accordance with their respective locations.

The invention is of course not restricted to the above exemplifying embodiments alone, but in its details it may show even considerable variation within the scope of the patent claims.

Thus, a particular embodiment of the joint construction in accordance with the present invention between slab-shaped elements is concerned in silos at the vertical joints between wall elements in the case of such silo constructions as are provided with hoops tightened around the construction on the outside.

What we claim is:

1. A lengthening joint for use between a first concrete object and a second concrete object, the first concrete object having one surface to be secured on one surface of the second concrete object, comprising a first joint component and a second joint component, the first joint component having a first surface on one side thereof adapted to engage the one surface of the first concrete object and a second surface on the side thereof opposite the first surface thereof, the second joint component having a first surface on the one side thereof adapted to engage the one surface of the second object and a second surface on the side thereof opposite the first surface thereof, the second surface of the first joint component having a protuberance, and the second surface of the second joint component having a recess, and the second surface of the first joint component mating with the second surface of the second joint component, characterized by the improved construction wherein the first and second joint components are constructed of concrete of higher strength than the concrete of the first concrete object and the second concrete object, and the cross sectional area of the second surface of the first joint component is smaller than the cross sectional area of the first surface of the first joint component.

2. A lengthening joint for use between a first concrete object and a second concrete object comprising the combination of claim 1 wherein the cross sectional area of the second surface of the second joint component is smaller than the cross sectional area of the first surface of the second joint component.

3. A lengthening joint for use between a first concrete object and a second concrete object comprising the combination of claim 1 wherein the second joint component is provided with an outwardly extending console.

4. A lengthening joint for use between a first concrete object and a second concrete object comprising the combination of claim 1 in combination with a plurality of bolts, each bolt having one end anchored in the first joint component and the other end anchored in the second joint component, the bolts being disposed outwardly of the second surface of the first joint component and the second surface of the second joint component.

* * * * *

UNITED STATES PATENT OFFICE

CERTIFICATE OF CORRECTION

Patent No. 4,123,888 Dated November 7, 1978

Inventor(s) Antero Kajava

It is certified that error appears in the above-identified patent and that said Letters Patent are hereby corrected as shown below:

Delete the named Assignee and insert the following:

Paraisten Kalkki Oy - Pargas Kalk Ab

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*